US005674084A

United States Patent [19]

Fukamachi

[11] Patent Number: 5,674,084

[45] Date of Patent: Oct. 7, 1997

[54] SHORT CIRCUIT CONNECTOR

[75] Inventor: Makoto Fukamachi, Yokkaichi, Japan

[73] Assignee: Sumitomo Wiring Systems, Ltd., Japan

[21] Appl. No.: 505,458

[22] Filed: Jul. 21, 1995

[30] Foreign Application Priority Data

Aug. 25, 1994 [JP] Japan ..... 6-225960

[51] Int. Cl.[6] ..... H01R 29/00

[52] U.S. Cl. ..... 439/188; 200/51.1

[58] Field of Search ..... 200/51.1; 439/188

[56] References Cited

U.S. PATENT DOCUMENTS

| | | | |
|---|---|---|---|
| 4,685,887 | 8/1987 | Hanning | 439/188 |
| 4,786,258 | 11/1988 | Shaffer et al. | 439/188 |
| 4,832,614 | 5/1989 | Jenkins | 439/188 |
| 4,850,888 | 7/1989 | Denlinger et al. | 439/188 |
| 5,064,973 | 11/1991 | Zinn et al. | 200/51.1 |

FOREIGN PATENT DOCUMENTS

| | | |
|---|---|---|
| 0 591 948 A2 | 4/1994 | European Pat. Off. . |
| 0 616 397 A2 | 9/1994 | European Pat. Off. . |
| 2-50985 | 4/1990 | Japan . |
| 2238672 | 6/1991 | United Kingdom . |
| 2245775 | 1/1992 | United Kingdom . |

*Primary Examiner*—Neil Abrams
*Assistant Examiner*—Barry Matthew L. Standig
*Attorney, Agent, or Firm*—Banner & Witcoff, Ltd.

[57] ABSTRACT

A short-circuit chamber 15 is provided in a female connector housing 11, and contains a short-circuit part 16 provided with left and right-hand resilient arms 18*a* which normally make contact with female terminal parts 13 to establish a conducting state. A male connector housing 21 is provided with insulating pieces 25 which, when the male and female housings are coupled, enter between the female terminal parts 13 and resilient arms 18*a* to break the electrical circuit. Projections 18*c* engage with the rear edges 15*d* of openings 15*c* to establish an engaged state of the short-circuit part 16. Insertion of the insulating pieces 25 disengages the projections 18*c* from the rear edges 15*d*, to allow the short-circuit part 16 to be taken out.

13 Claims, 5 Drawing Sheets

SHORT CIRCUIT CONNECTOR

TECHNICAL FIELD

The present invention relates to a short-circuit electrical connector in which the gap between the terminal metal-parts is in a conducting state prior to coupling, but in which the said gap is put into an insulated state upon coupling.

BACKGROUND OF THE INVENTION

In general, air bags for motor vehicles have an arrangement involving firing when in response to an air bag sensor a voltage difference is generated across two electrical terminals. The gap between the terminals therefore has to be continuously short circuited when the assembly is not connected to the air bag sensor, for example between manufacture and assembly into the vehicle. Conversely the gap must be open such that the air bag is operated normally when the air bag sensor is connected.

Thus, electrical connectors equipped with short-circuit members and the like have been developed as disclosed in Laid Open Japanese Utility Model Application Hei 2-50985.

As shown in FIG. 7 hereof, this prior art connector is equipped with connector housings 1 and 2 which are coupled together, and the first connector housing 1 (on the air bag side) is provided with a short-circuit member 4 between metal terminal parts 1 and 3. The short-circuit member 4 comprises two electrically conductive resilient pieces 5 and each of the resilient pieces 5 has one end connected to a respective terminal part 3 while the other ends are connected more or less in the centre between the terminal parts. In this way the terminal parts 3 are in a conducting state. The other connector housing 2 (on the air bag sensor side) has an insulating piece 6 provided projecting on the central area at its front, and when the connector housings 1 and 2 are coupled together, the insulating piece 6 nestles between the resilient pieces 5, thereby placing the connector housing 1 in a non-conducting state.

However, in the non-conducting state, the resilient pieces remain inside the connector housing and are present a slight distance apart with the insulating piece between them. It is not possible to ignore the possibility that, if a substantial impact is sustained, the resilient pieces may again make contact and place the terminal parts in a conducting state. Furthermore, in the above configuration in which the conducting state is broken by making an insulating piece nestle between resilient pieces, there will be cases when the insulating piece will not nestle between the insulating pieces, for example because errors in the dimensions of the insulating piece or the like are too large, and thus the conducting state cannot be broken.

The present invention has taken the above situation into account, and it aims to provide a short-circuit connector which is adapted to ensure that the conducting state between terminal parts is reliably broken when coupling together connector housings.

SUMMARY OF THE INVENTION

According to the invention there is provided a short-circuit connector assembly comprising a first connector having two electrical terminals and a short-circuit member engaged therewith to provide electrical continuity, and a second connector having a continuity breaking member engageable between said terminals to break electrical continuity, said short-circuit member being removable on coupling of said first and second connectors.

According to the invention the gap between terminal parts in the first connector is in a conducting state when the connector housings are not coupled, due to the short-circuit member. When the connector housings are coupled together, the continuity-breaking member provided in the other connector housing engages between the terminal parts to put them into an electrically insulated state. The short-circuit member is removable from the first connector to ensure that inadvertent shorting is not possible.

Preferably, the short-circuit member is engaged with the connector housing and cannot be taken out of the connector housing when the companion connector is not coupled. Then, when electrical continuity between the terminal metal-parts is broken by the continuity breaking member due to the coupling of the connector housings, the short-circuit member is disengaged from respective connector housings and can consequently be removed.

Thus the present invention has the advantage that it can reliably prevent any further connection between the terminal parts even if an impact is sustained, since the short-circuit member can be taken out from the connector housing. Preferably, the short-circuit member includes a latch to prevent removal thereof from the first connector when in the uncoupled state, and said second connector includes a latch releasing member to release said latch on coupling of said connectors. This ensures that the short-circuit member can be prevented from being taken out unintentionally prior to coupling of the connector assembly.

The present invention is now described with reference to a preferred embodiment shown by way of example only in the accompanying drawings, in which.

Figure 1:
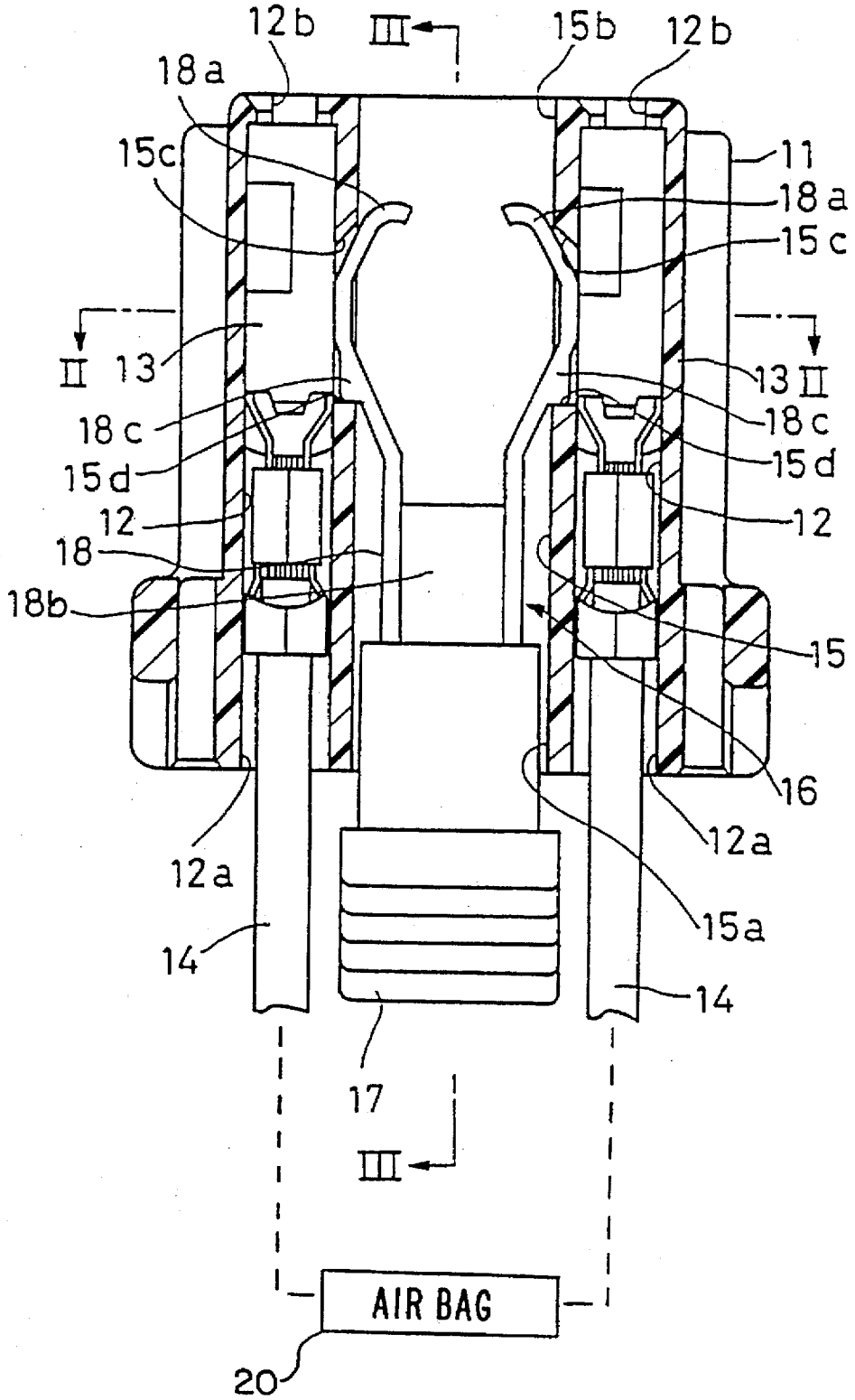
FIG. 1 is a cross-section illustrating the female-side connector housing of the preferred embodiment.
Figure 2:
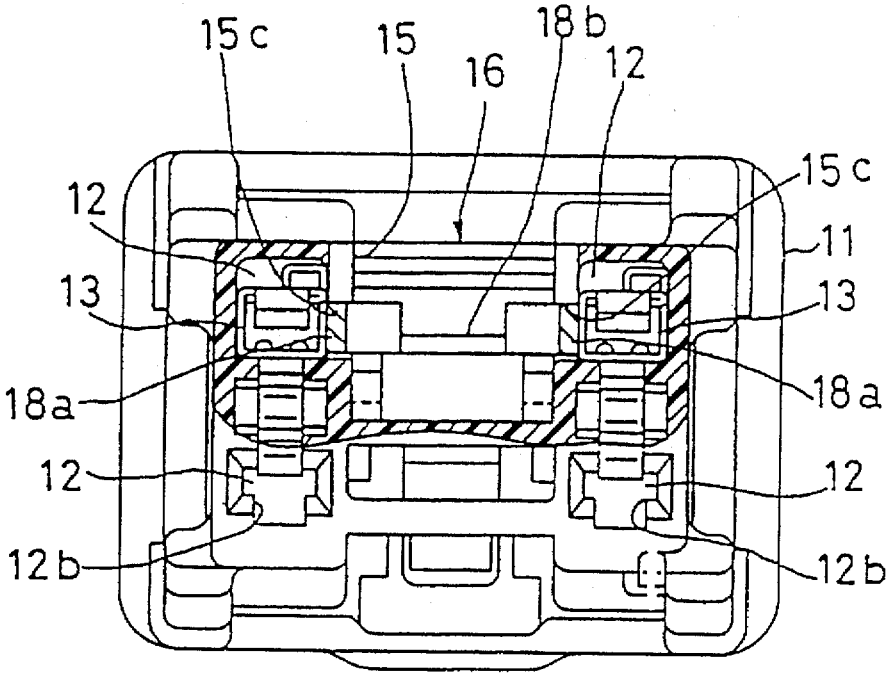
FIG. 2 is a cross-section along the line II—II in FIG. 1.
Figure 3:
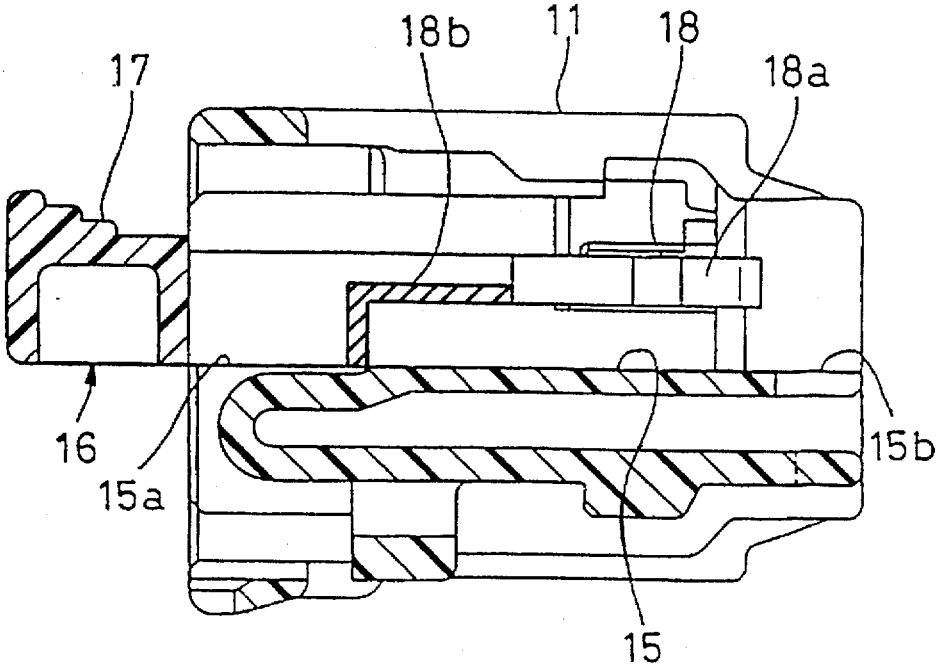
FIG. 3 is a cross-section along the line III—III of FIG. 1.
Figure 4:
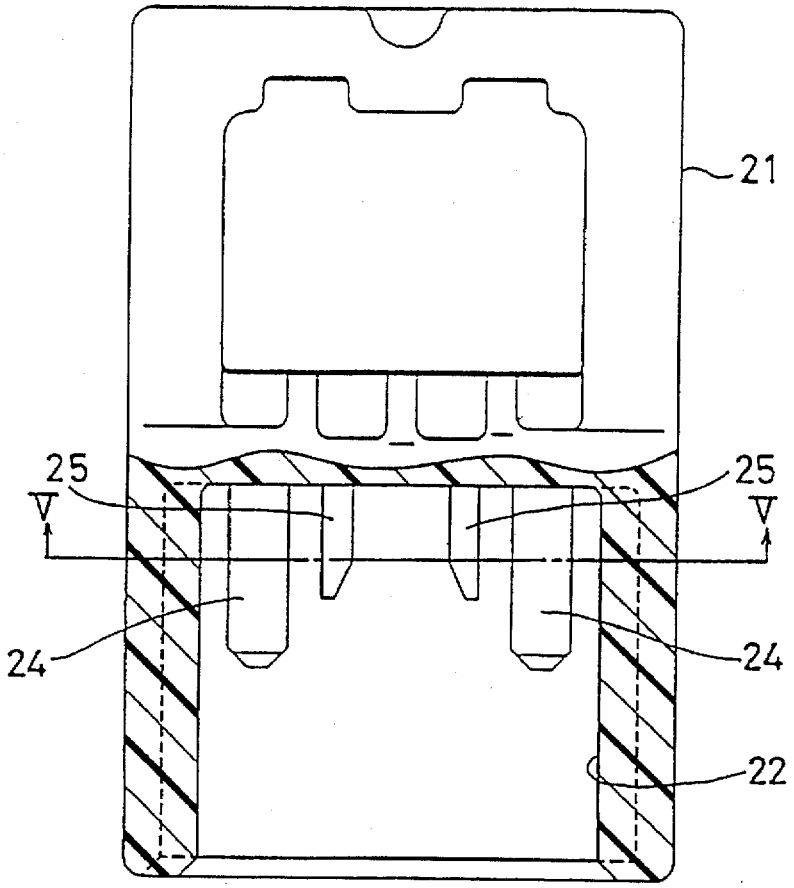
FIG. 4 is a cross-section illustrating the male-side connector housing.

As shown in FIG. 1 to FIG. 3, the female-side connector housing in the short-circuit connector of the present embodiment has a total of four female-terminal accommodation chambers 12 arranged in a rectangle inside a connector housing 11. As regards each of these chambers 12, there are terminal-fitting openings **12*a* in the rear surface of the female connector housing 11, and, in the front surface, there are male-terminal insertion openings 12*b*, in which are inserted male terminal metal-parts 24 which are provided on the male-side connector housing 21 (FIG. 4). Female terminal metal parts 13 are accommodated in the female terminal accommodating chambers 12, and electrical wires 14 are lead out from the openings 12*a* provided in the rear surface. The other ends of the electrical wires 14 are connected to an air bag 20** (not depicted in detail).

A chamber 15 for accommodating a short-circuit metal part is provided in the female-side connector housing 11, between those female terminal accommodating chambers 12 positioned on the upper side. The walls to the rear of the short-circuit chamber 15 are open and constitute an inlet/outlet **15*a* for inserting or taking out a metal short-circuit part 16 discussed hereinbelow. Furthermore, the front walls are also open and constitute an insertion port 15*b* for inserting insulating pieces 25 discussed hereinbelow. In addition, openings 15***c* are provided on the two side walls to left and right of the short-circuit chamber 15, and these are linked to the female terminal accommodating chambers 12 as illustrated.

The short-circuit part 16 consists of a holding area 17 and a short-circuit area 18, the short-circuit area 18 being linked to the front (the upper side of FIG. 1) of the holding area 17. This short-circuit area 18 is equipped with left and right-hand resilient arms 18*a* with conductive wire properties. These arms 18*a* are slightly opened apart outwards and, when they are accommodated in the short-circuit accommodating chamber 15, the arms 18*a* expand into the female terminal accommodating chambers 12 via the openings 15*c*. Furthermore, the arms 18*a* are provided on their outsides, slightly above their bases, with engaging projections 18*c* such that, when the short-circuit part 16 is accommodated in the short-circuit chamber 15, the engaging projections 18*c* engage with the rear edges 15*d* (the lower edges in FIG. 1) of the openings 15*c*.

Figure 5:
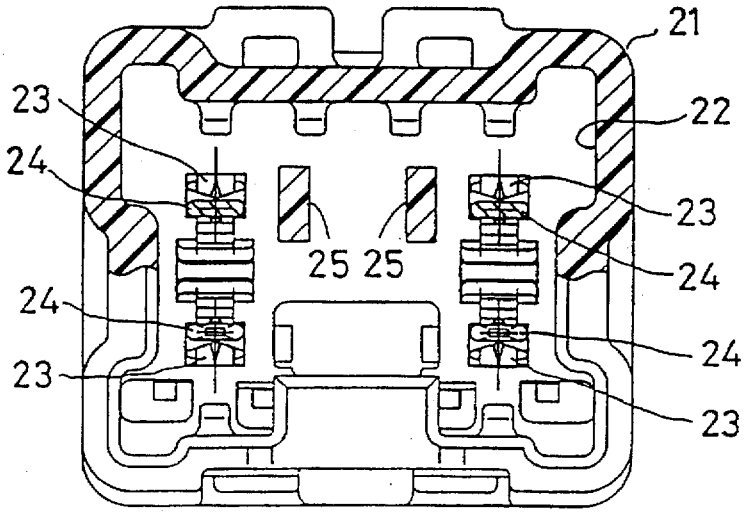
FIG. 5 is a cross-section along the line V—V in FIG. 4.
Figure 6:
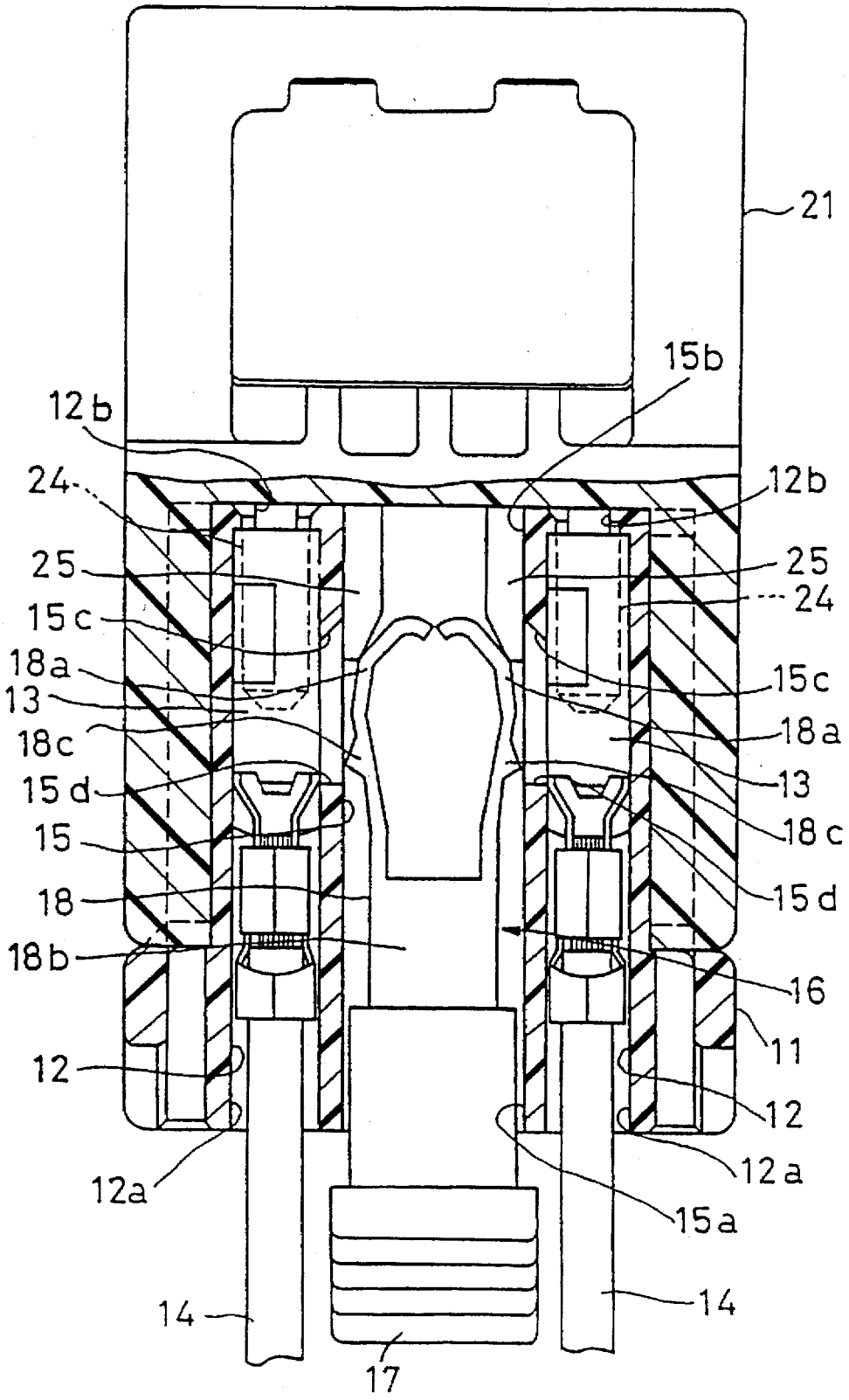
FIG. 6 is a cross-section illustrating the male and female connector housings in the coupled state.
Figure 7:
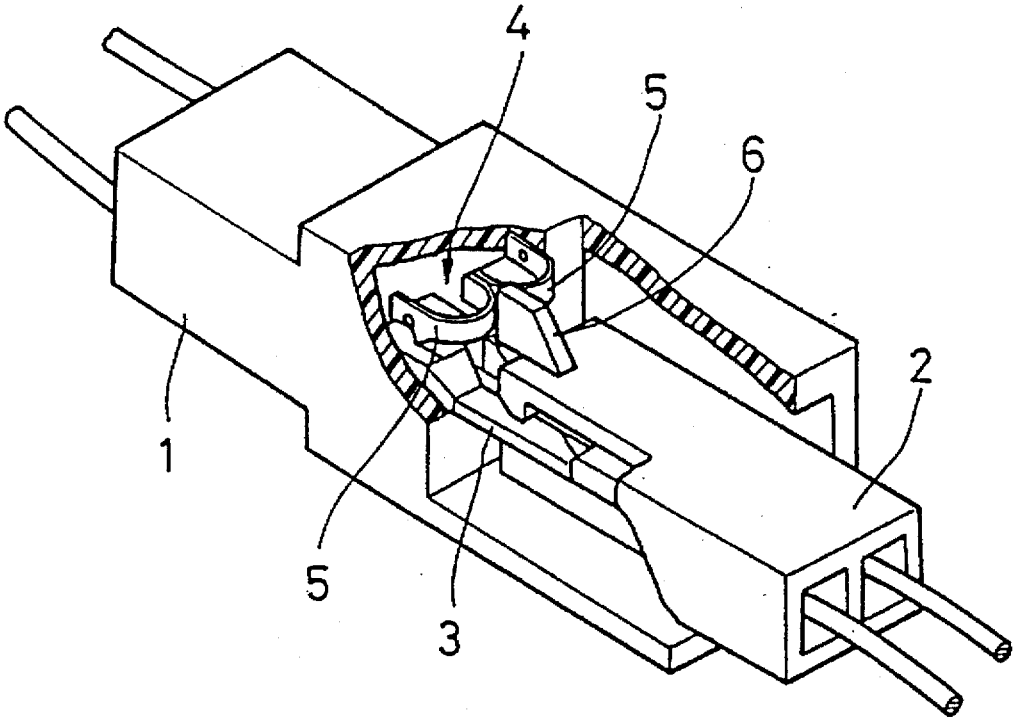
FIG. 7 (PRIOR ART)
FIG. 7 is an oblique view illustrating an example of the prior art.

The male-side connector housing 21 is shown in FIG. 4 and FIG. 5, and is provided with a connector housing accommodating chamber 22 opening to the front so as to be able to accommodate the above-mentioned female-side connector housing 11. Furthermore, a total of four male-terminal accommodating chambers 23 are provided inside the male-side connector housing 21, corresponding to the respective chambers of the female housing 11 and metal male terminal parts 24 are accommodated in the chambers 23 so as to project into accommodating chamber 22. Moreover, although this is not depicted, electrical wires are connected to the male terminal parts 24 and the other ends of these electrical wires are connected to an air bag sensor.

A pair of left and right-hand insulating pieces 25 project between the male terminal parts 24 as illustrated. In use these insulating pieces 25 are inserted into the short-circuit chamber 15 when the connector housings 11 and 21 are coupled together, and the distance between the insulating pieces 25 is more or less equal to the distance between the left and right walls of the short-circuit chamber 15. Also, their length is shorter than the lengths of the portions of the male terminal parts projecting into the connector housing chamber 22. Further, outer ends of the insulating pieces 25 chamfered on the inside thus becoming thinner towards the extreme end.

The operation of the present embodiment is now described. Once the female terminal parts 13 are accommodated in the female accommodating chambers 12, the short-circuit part 16 is inserted into the short-circuit inlet/outlet 15*a*, as illustrated in FIG. 1. As this is done, the resilient arms 18*a* of the short-circuit area 18 are squeezed together against their resilient force by the side walls of the short-circuit chamber 15. Then, once the short-circuit part 16 is pushed further in and the engaging projections 18*c* of the arms 18*a* reach the openings 15*c*, and the arms 18*a* are slightly separated under their resilient force into the female accommodating chambers 12, and make contact with the female terminal parts 13, thereby establishing a conducting state. Furthermore, the engaging projections 18*c* engage with the rear edges 15*d* of the openings 15*c* to stop the short-circuit part 16 from being withdrawn.

The female-side connector housing 11 which is in the state described above is accommodated inside the accommodating chamber 22 of the male-side connector housing 21, and the male and female connector housings 21 and 11 are coupled. At this time, as well as the coupling action, the male terminal parts 24 fit into the female terminal parts 13 to place the connector in the conducting state. The insulating pieces 25 of the male connector housing 21 slide along the inner walls of the short-circuit chamber 15 and their front ends come to abut against the front ends of the respective resilient arms 18*a*. Further movement inward causes the front ends of the insulating pieces 25 to enter between the arms 18*a* and the female terminal parts 13, so that the arms 18*a* are urged inwardly against their resilient force. This causes the respective arms 18*a* to separate from the female terminal parts 13 so that the conducting state between the female terminal parts 13 is broken. Furthermore, the engaging projections 18*c* disengage from the rear edges 15*d* of the openings 15*c* and short-circuit part 16 is thereby unlatched. Here, because the length of the insulating pieces 25 is shorter than the lengths of the male terminal parts 24 the state of electrical continuity between the female terminal parts 11 is broken only after the male terminal parts 24 have entered the female terminal parts 13 to complete the corresponding electrical circuits.

If the holding area 17 of the short-circuit part 16 is held and pulled outwards after the male and female connector housings 11 and 12 have been coupled together, the short-circuit part 16 can be withdrawn from the short-circuit chamber 15.

Thus, in the present embodiment, there can be no electrical connection between the female terminal parts 13 after the male and female connector housings 11 and 12 have been coupled, even if a substantial impact is sustained, provided that the short-circuit part 16 is removed. Furthermore, even if there is substantial dimensional error in the insulating pieces 25 or the like and the resilient arms 18*a* do not separate from the female terminal parts 13, the short-circuit part 16 can still be withdrawn and thus the gap across the female terminal parts 13 provides reliable insulation. Consequently, when an emergency situation arises, the air bag can be operated-reliably by the air bag sensor.

Due to the provision of the engaging projections 18*c* and the like, the short-circuit part 16 is prevented from being pulled out or dropping out when the connectors are not coupled. Consequently, the air bag will not be actuated unintentionally when the sensor is not connected to the air bag for example during transport and assembly.

It should be noted that the present invention is not limited to the embodiments described above and, for example, the invention can be modified in several ways and these embodiments are also included in its technical scope.

The present embodiment concerns a configuration in which the short-circuit part 16 is provided in the female connector housing 11 and the insulating pieces 25 are provided in the male connector housing 21, but, conversely, a configuration may also be adopted in which the insulating pieces are provided in the male connector housing 21 and the short-circuit parts in the female connector housing.

Furthermore, in the present embodiment engaging projections 18*c* are provided in the short-circuit part 16, the engaging projections are optional and need not be provided.

As described the short-circuit part 16 acts between two of the terminals of the female connector housing; the arms 18*a* could be arranged to contact additional terminals, or more than one short-circuit part could be provided if desired.

Various other modifications can also be put into practice without departing from the scope of the present invention.

I claim:

1. A short-circuit connector assembly comprising a first electrical connector having two electrical terminals, a short-circuit member electrically engaged with said terminals to provide electrical continuity, and a second electrical connector having a continuity breaking member engageable between said terminals to break electrical continuity through said short circuit member, said short-circuit member being removable from the connector assembly on coupling of said first and second connectors.

2. An assembly according to claim 1 wherein said short-circuit member comprises two resilient arms engageable one each with a respective terminal of the first connector.

3. An assembly according to claim 2 wherein said arms are biased outwardly of each other.

4. An assembly according to claim 2 wherein said continuity breaking member engages said arms.

5. An assembly according to claim 4 wherein said continuity breaking member includes a projection to separate one of said arms and an associated terminal.

6. An assembly according to claim 5 wherein said continuity breaking member includes two projections, one each for engagement between a respective arm and terminal.

7. An assembly according to claim 6 wherein said second connector includes projecting electrical terminals for engagement with the terminals of said first connector, said projecting terminals projecting further than said projections.

8. An assembly according to claim 1 wherein said short-circuit member includes a latch member to prevent removal thereof from the first connector prior to coupling of said first and second connectors, and said second connector includes a latch releasing member to release said latch on coupling of said first and second connectors.

9. An assembly according to claim 8 wherein said continuity breaking member comprises said latch releasing member.

10. An assembly according to claim 8 wherein said latch member comprises a projection of said short-circuit member engageable with an abutment of said first connector.

11. An assembly according to claim 10 wherein said projection is resiliently biased into engagement with said abutment.

12. An assembly according to claim 8 wherein the second connector includes two electrical terminals for engagement with respective terminals of the first connector, said terminals being adapted to be electrically engaged on coupling of said connectors prior to release of said latch member.

13. An assembly according to any one of claims 1 to 11, wherein the second connector includes two electrical terminals for engagement with respective terminals of said first connector, said terminals being adapted to be electrically engaged on coupling of the first and second connectors prior to continuity breaking engagement of said continuity breaking member.

* * * * *